US006471264B1

(12) United States Patent
Ryan

(10) Patent No.: US 6,471,264 B1
(45) Date of Patent: Oct. 29, 2002

(54) DOOR SECURITY APPARATUS

(76) Inventor: Gary D. Ryan, 1697 Braid Road, Delta, B.C. (CA), V4L 1T5

( * ) Notice: Subject to any disclaimer, the term of this patent is extended or adjusted under 35 U.S.C. 154(b) by 0 days.

(21) Appl. No.: 09/654,667

(22) Filed: Sep. 5, 2000

(30) Foreign Application Priority Data

Sep. 3, 1999 (CA) ..... 2283545

(51) Int. Cl.[7] ..... E05C 17/44

(52) U.S. Cl. ..... 292/338; 292/339; 292/259; 292/289; 292/292; 292/295; 292/262; 292/277; 292/251.5

(58) Field of Search ..... 292/338, 339, 292/259, 258, 292, 295, 262, 277, 251.5

(56) References Cited

U.S. PATENT DOCUMENTS 3,690,709 A * 9/1972 Bogusz ..... 292/262
4,601,502 A * 7/1986 Van Dyke ..... 292/252
4,666,195 A * 5/1987 Thomas, III ..... 292/338
5,040,835 A * 8/1991 Barker ..... 292/338
5,340,172 A * 8/1994 Sweet ..... 292/259
5,398,982 A * 3/1995 Watson ..... 292/259 R
5,454,143 A * 10/1995 Wigley ..... 16/82
5,531,490 A * 7/1996 Parker ..... 292/262
5,618,072 A * 4/1997 Pitchford ..... 292/339
5,725,263 A * 3/1998 Rodriguez ..... 292/338

* cited by examiner

*Primary Examiner*—Carl D. Friedman
*Assistant Examiner*—Dennis L. Dorsey
(74) *Attorney, Agent, or Firm*—Bruce A. Kaser

(57) ABSTRACT

A door security device operative to secure the door in a fully closed and partially opened state is disclosed. A vertically oriented housing mounted close to the handle side on the inside surface of the door contains a coaxial brace bar, the bottom end of which extends out of the housing, but does not reach the floor. A second vertically oriented brace bar is slideably mounted onto horizontal rods, which are affixed proximate to the bottom of the vertical brace bar. To lock the door, the bottom end of the slideable brace bar is inserted into one of two different floor plugs, the first of which is positioned adjacent to the location of the closed door (bracing the door in a fully closed position) and the second of which is positioned slightly interior to the first (bracing the door in a manner that allows it to be partially opened). If no security is desired, the entire device may be lifted in the housing, rotated into planar contact with the door, and locked in an inactive position. The locking mechanism can also be used to lock the device in any of the active positions.

25 Claims, 11 Drawing Sheets

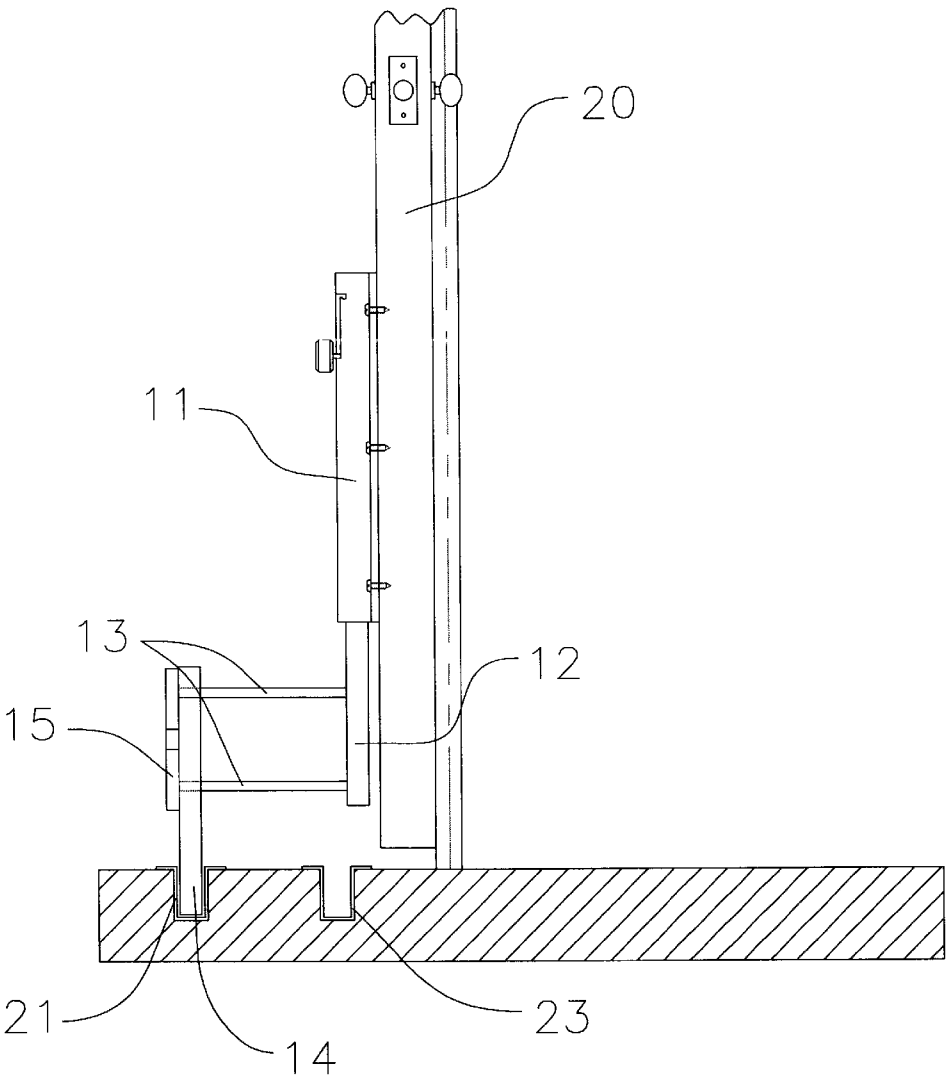
FIGURE 1–A

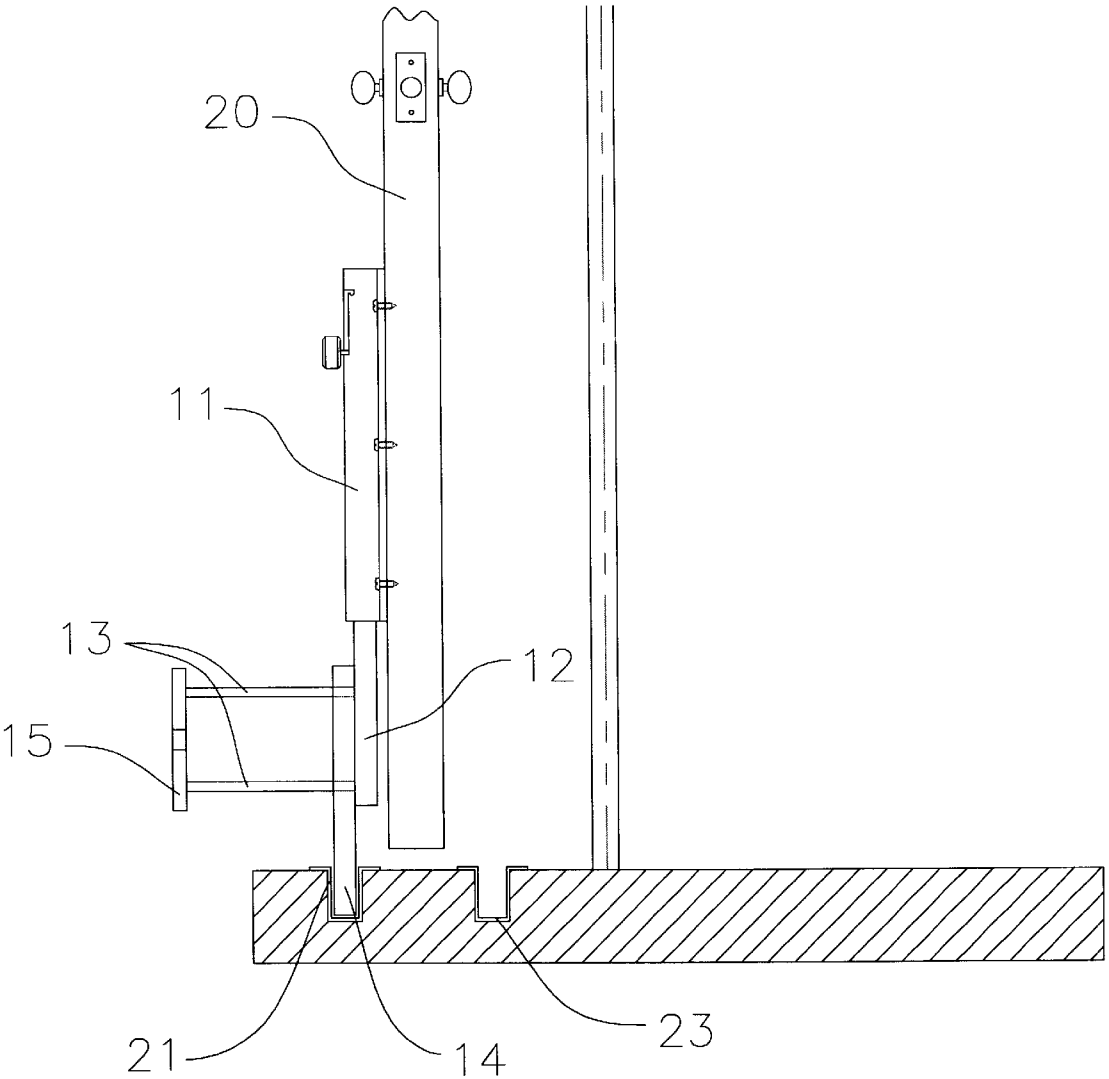
FIGURE 1-B

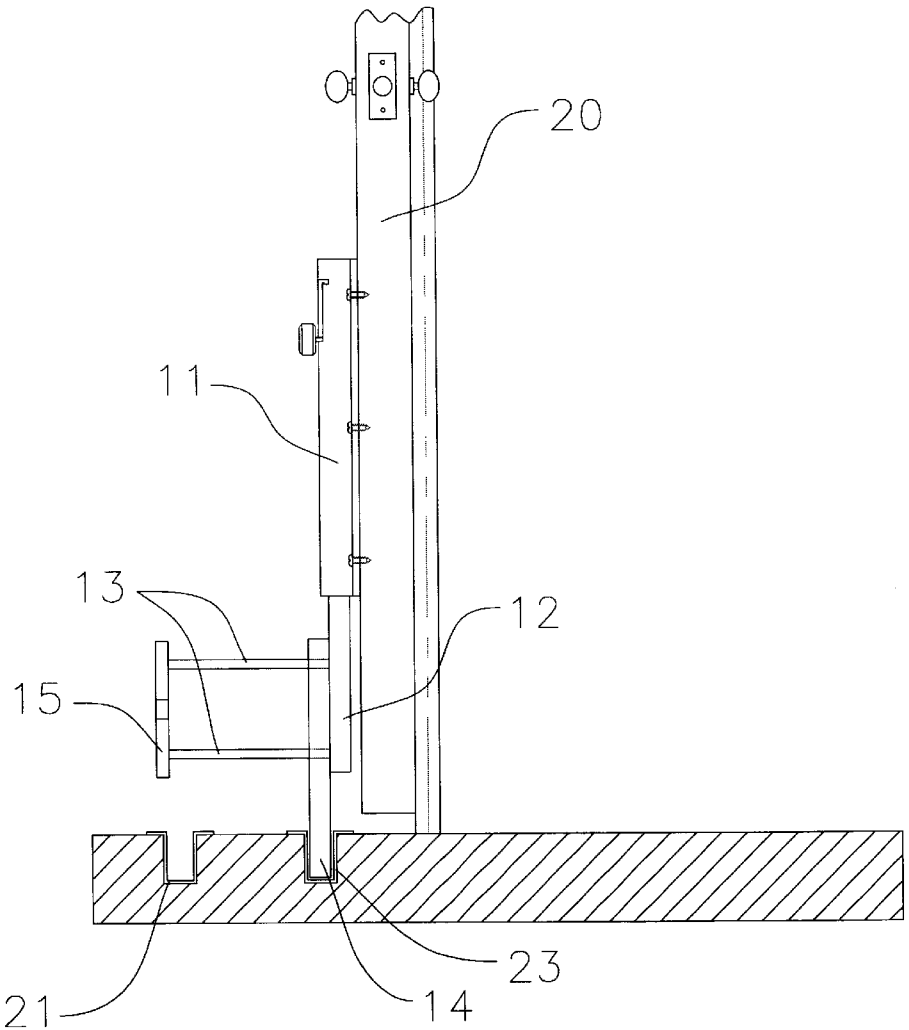
FIGURE 1–C

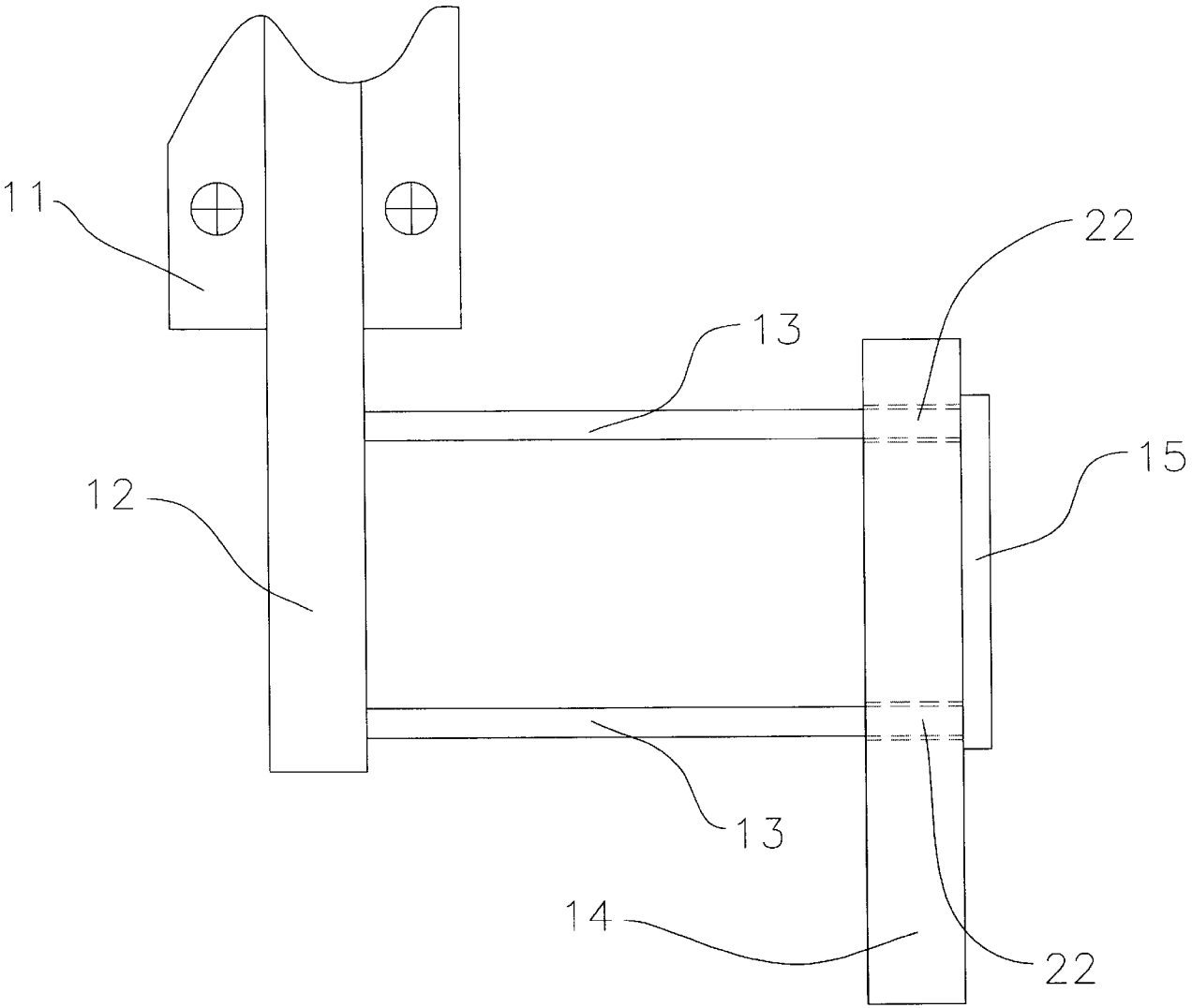
FIGURE 2-A

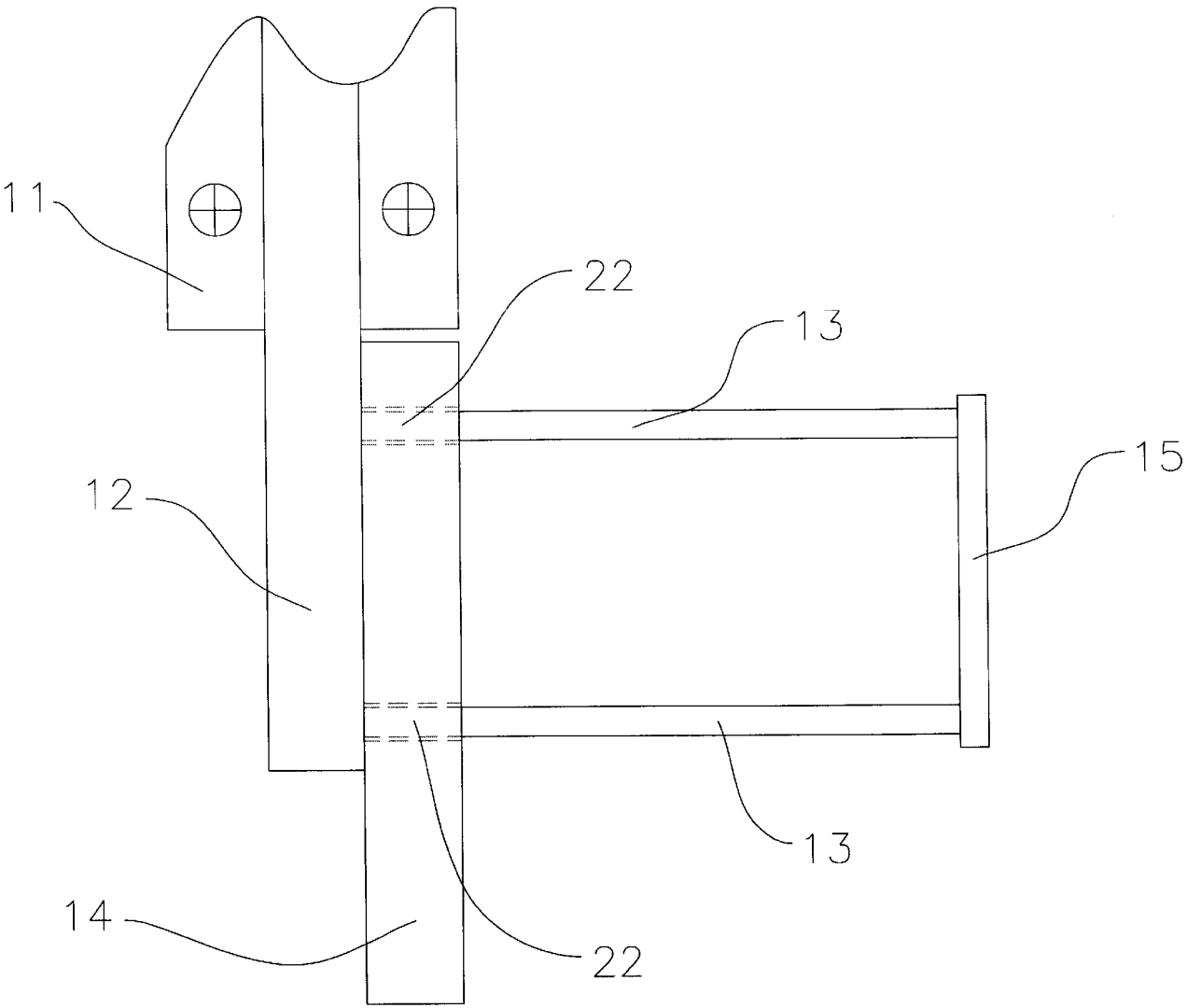
FIGURE 2-B

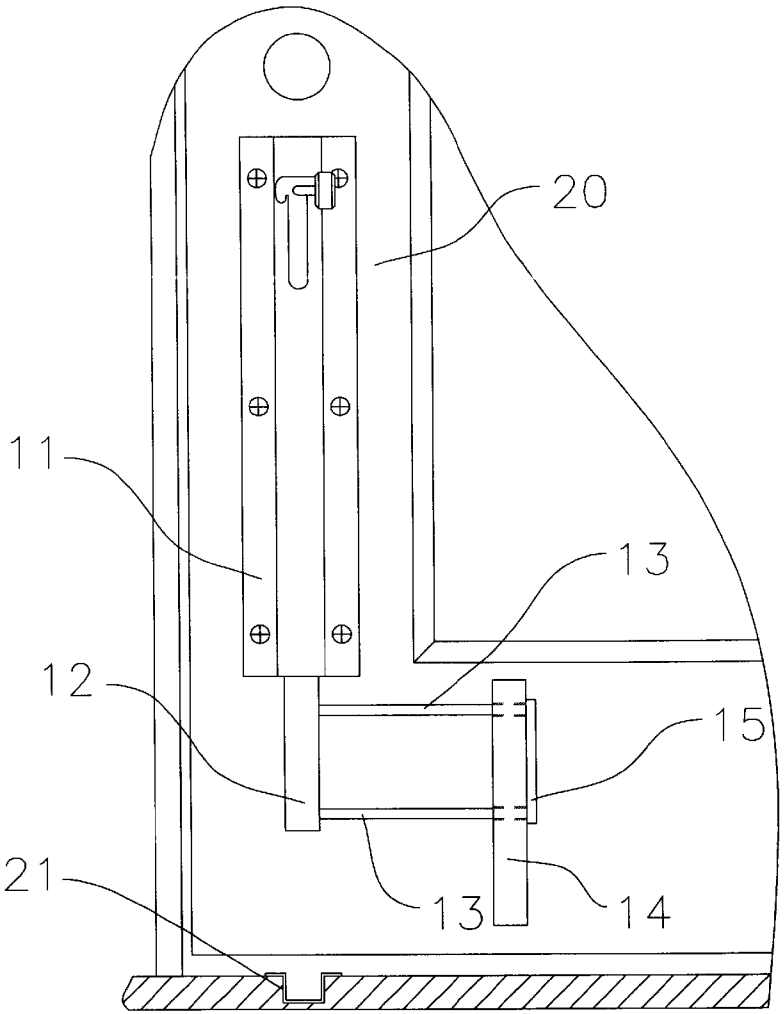
FIGURE 3-A

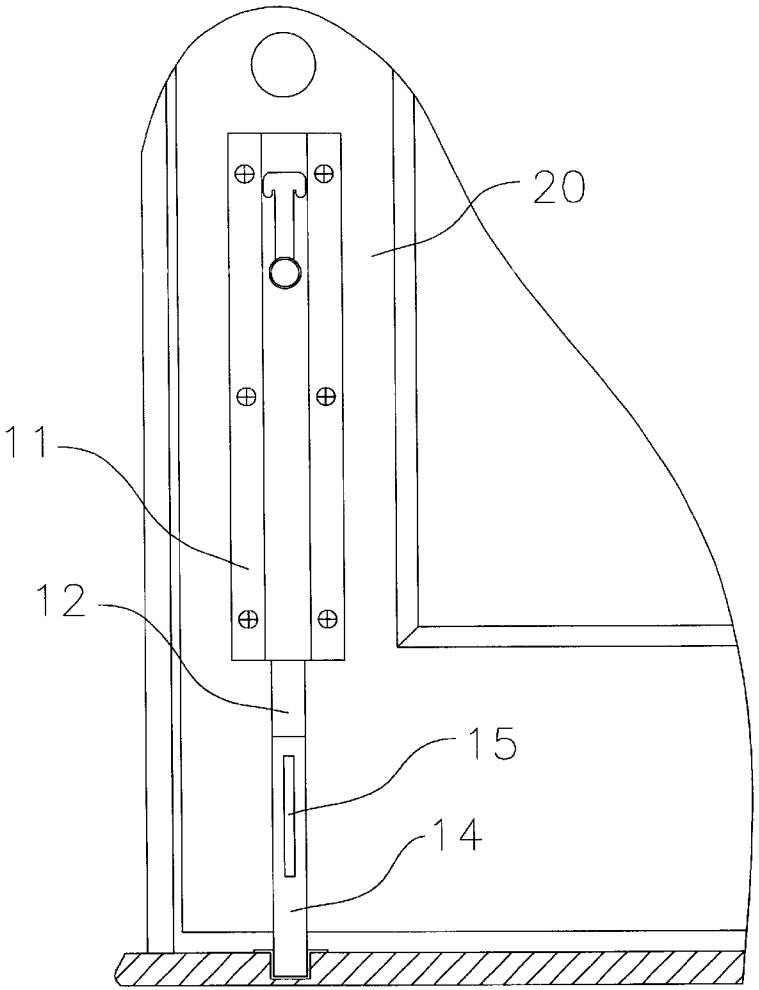
FIGURE 3-B

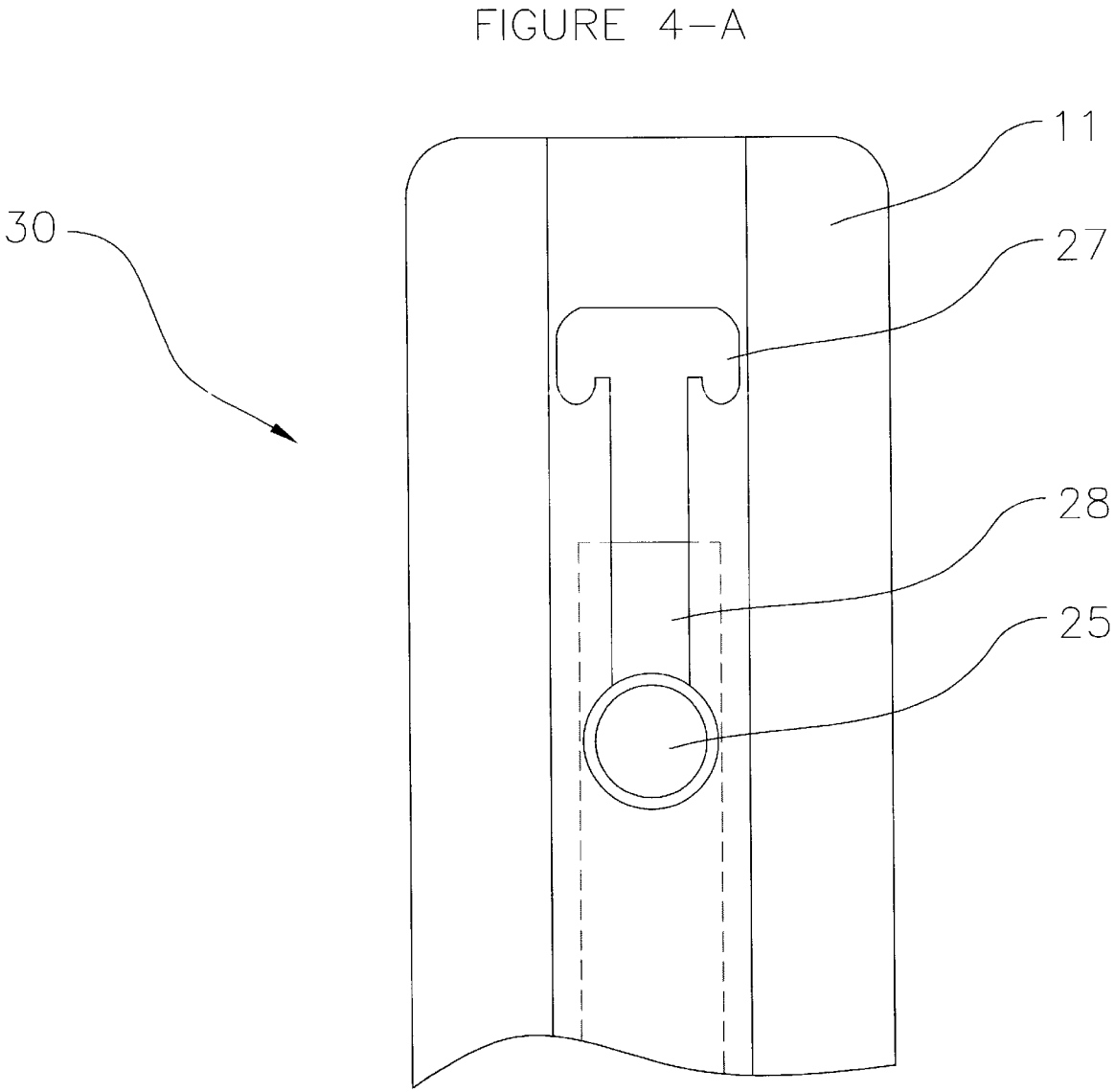
FIGURE 4–A

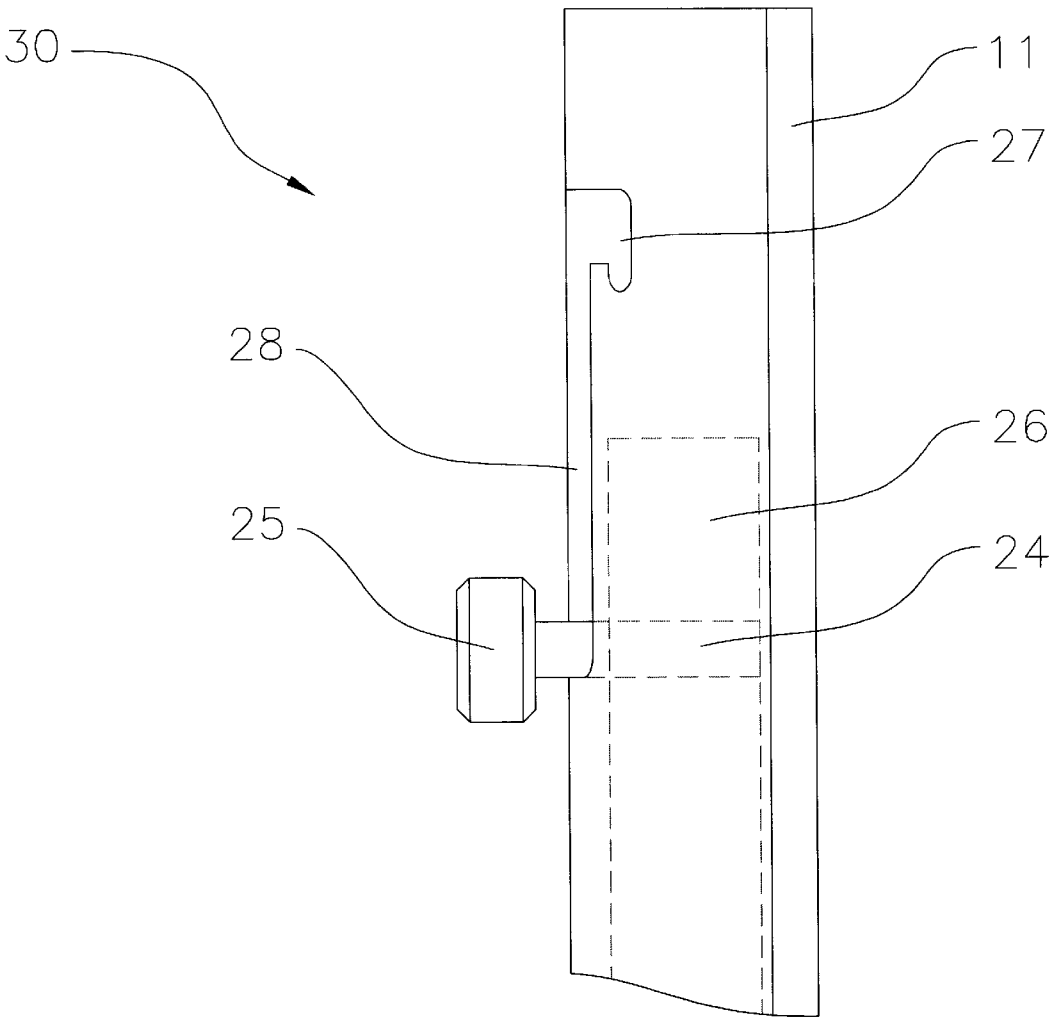
FIGURE 4-B

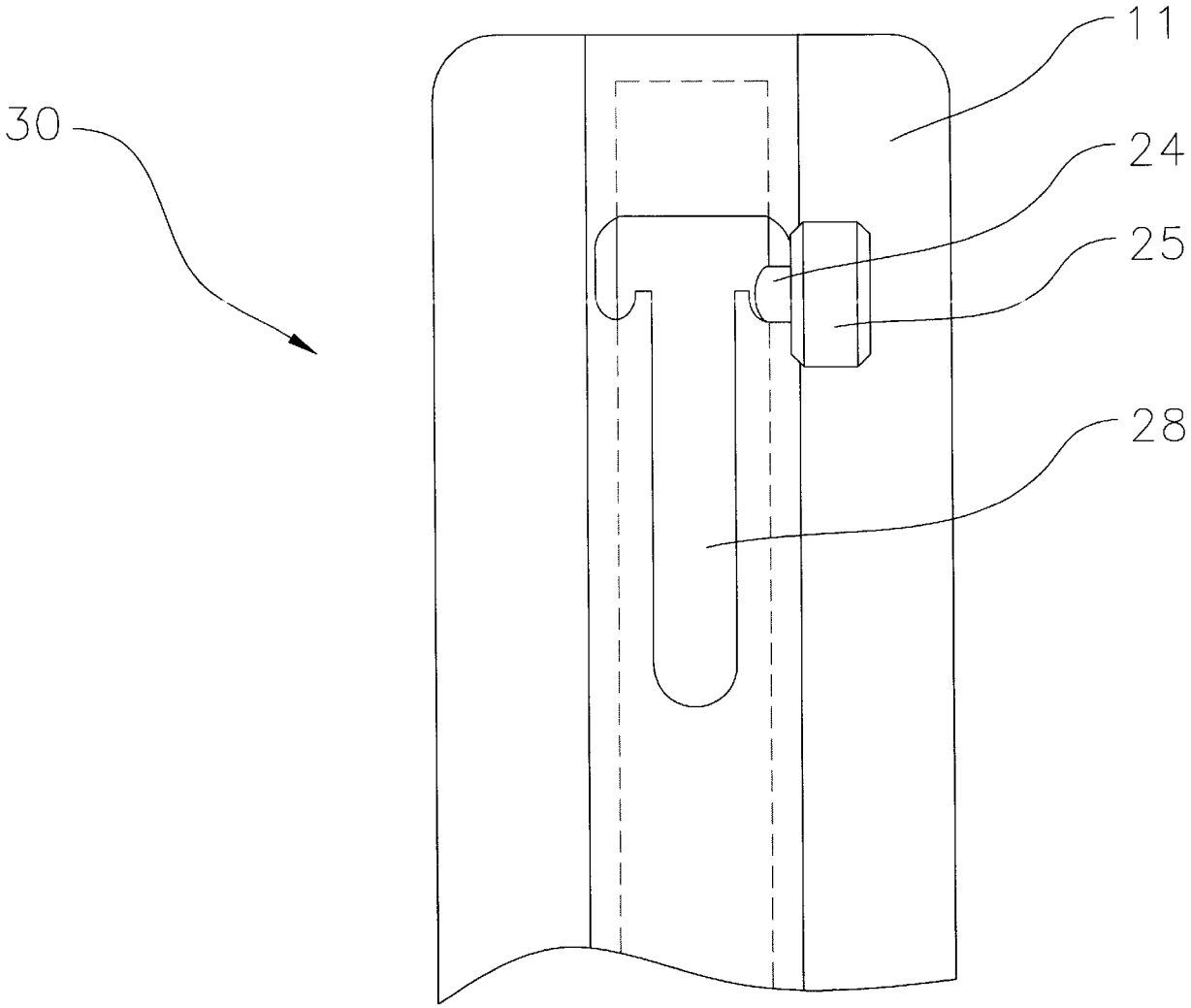
FIGURE 5-A

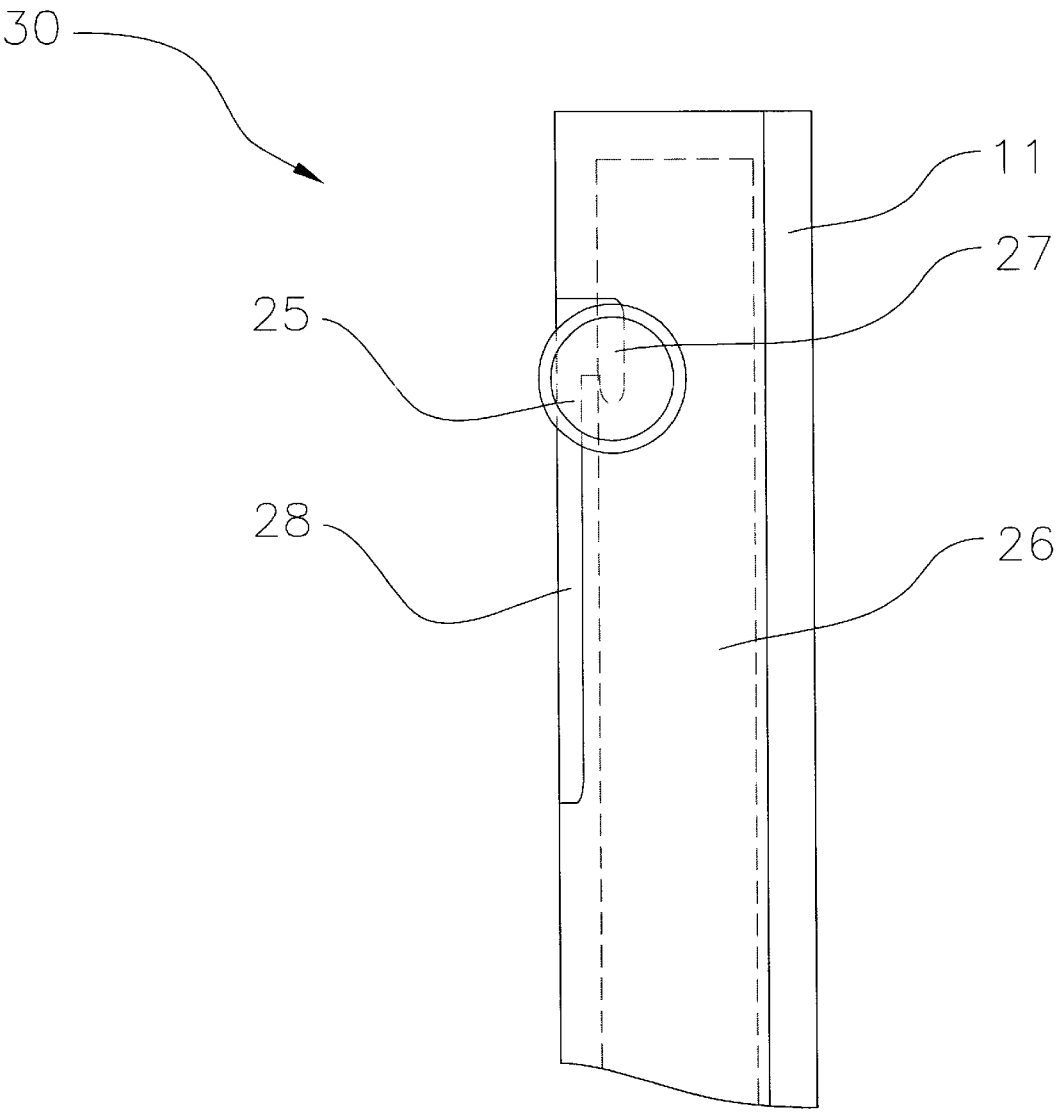
FIGURE 5-B

DOOR SECURITY APPARATUS

FIELD OF THE INVENTION

The present invention relates generally to door security devices which allow locking of the door in a fully closed position and a partially open position. The invention has specific application to the field of protection from home invasion and forced entry of any premises or building.

BACKGROUND OF THE INVENTION

Residential security is an unfortunate but necessary part of owning or renting a home. Security of a commercial premises is also essential. Most premises are equipped with standard type door locks, dead-bolts and latches, which are effective when the door is closed, but it is frequently desirable to allow the door to open partially to talk to visitors. Opening the door subjects the occupants to an increased threat of home invasion or forced entry. Typical devices, such as door chains, designed to permit partial opening of the door, are inherently weak. The mounting of the chain and its components to the door frame and the door itself may be broken or torn from the their attachments. As such, there is a need in the market for door security devices that permit partial opening of the door without compromising security.

Many prior art devices have been developed which purport to solve this problem. However, none of the devices have been commercially successful because each of them has innate disadvantages that make them unattractive, nonfunctional or merely ineffective. The following represents a short discussion of the prior art inventions and the weaknesses thereof.

U.S. Pat. No. 3,690,709 (hereinafter referred to as '709) is a cable based locking system. The cables attach to specialized hinges and are disposed so as to extend from each hinge angularly across the interior surface of the door to the bottom handle side corner. At the bottom handle side corner of the door, the cables are engaged via an offset flange to a rotating pivot bolt which is secured to the floor and/or the wall. The '709 invention lacks visual appeal. People who have an interest in the aesthetic appeal of their homes or commercial establishments are unlikely to purchase an invention such as this, which requires the permanent fixture of cables covering most of the door's interior surface. In addition, the cables are bulky and may reduce the functionality of the door as they take up a considerable amount of room. The device also puts a relatively large amount of torque and shear force on the pivot bolt. The offset flange, required by this invention to permit partial door opening, has the effect of laterally displacing the device's bracing elements (the pivot bolt and its housing) away from the edge of the door. However, any force exerted to open the door is still exerted at the door's edge and causes a torque on the pivot bolt which is proportional to the length of the offset flange and the force itself. Finally, the device requires the purchase specialty hinges, which add to the expense of the invention and to the complexity of installation.

U.S. Pat. No. 4,601,502 (hereinafter referred to as '502) is a recessed floor plug with a spring loaded lock bar, which, when engaged, extends upwards from the floor plug, so as to block the path of the door. When not engaged, the lock bar retracts into the floor so that it is not intrusive. The lock bar is engaged by exerting downward pressure on the top of the bar, which depresses the bar below the floor surface and activates a spring release mechanism. One disadvantage of the '502 invention is its arrangement in the floor. Because the invention has a relatively large number of moving parts, all housed in the recessive floor plug, dirt, dust and other contaminants (which accumulate naturally in doorways) can interfere with the device performance. The concentric arrangement of the lock bar within the floor plug is an entirely vertically oriented apparatus. Consequently, the device has little horizontal bracing, making it weaker when acting against horizontal forces tending to open the door. An additional consequence of the concentric arrangement is that the lock bar can only be as long as the depth of the floor plug. A large force acting against the upper part of the door can cause the door itself to break over the relatively short lock bar. Finally, the activation mechanism of the invention is difficult to operate. If the activation mechanism requires depression well below the floor, then a person may need to bend to floor level and use their hands; conversely, if the activation mechanism requires only minimal depression, then a person or household pet may accidentally activate the device by walking on it.

U.S. Pat. No. 5,040,835 (hereinafter referred to as '835) comprises an angularly disposed rod, one end of which fits into an angular floor plug. The other end of the rod is inserted into a door mounted keeper and is vertically slideable therein, such that when the door is opened slightly, the rod slides vertically in the keeper and the rod angle changes. The disadvantages of the '835 invention include the relatively large amount of space that the angularly disposed rod occupies in the entranceway of the premises. The floor plug of the device is also difficult to install, because it must be drilled at an angle and in precisely the correct location to permit the rod to translate properly within the keeper. In addition, the floor plug must be bored sufficiently wide to accommodate both different angular orientations of the rod. The extra room in the plug introduces play in the device and permits torque to act against the rod about the floor axis, such that an intruder may agitate the device, potentially bending or breaking it. Agitation, in turn, may cause the rod to slide within the keeper, allowing the door to partially open in undesirable situations and permitting extra torque to be applied to the rod.

U.S. Pat. No. 5,454,143 (hereinafter referred to as '143) consists of a horizontal brace, which is slideably and rotatably inserted into a floor plug. When the door opens against the device, it rotates in the floor plug until the horizontal brace is in planar contact with the door. The '143 invention has no locking mechanism, so an intruder may reach around a door that is slightly open with an arm or possibly a long instrument and unfasten the device. For this reason, the device is ordinarily disposed at the hinge side of the door. However, when the brace is located at the hinge side of the door, it does not provide as much torque to counteract the opening of the door. The invention also discloses a "dispersion plate" mounted onto the door, which is claimed to protect the door from damage caused by the brace. The dispersion plate will not do much to disperse the force as the invention claims, because the dispersion plate shown in the disclosure is not much larger than the horizontal brace itself. The '143 invention also suffers from the drawback that there is no effective place to store the bracing device when it is not in use. The bracing device must be detached from the door and may be hung on a hook. This requires the person to bend approximately to ground level to activate or deactivate the lock. In addition, the '143 invention does not disclose a mechanism of locking the door in its closed position.

U.S. Pat. No. 5,531,490 (hereinafter referred to as '490) discloses an "S-shaped" pivot bar, one end of which is inserted into a floor plug while the other end is allowed to translate horizontally within a brace on the interior surface of the floor. As one end of the pivot bar translates along the interior surface of the door, the pivot bar rotates and the door is allowed to open slightly. The major disadvantage with the '490 invention is that it requires extensive modification to the door to provide a gap thereunder. The gap is required to allow the horizontal cross-piece of the pivot bar to rotate under the door. Not only does this gap involve extensive installation procedures and expense, it also permits an intruder to extend an elongated instrument under the door to cut or disengage the pivot bar. Additionally, a resident must bend nearly to floor level to activate or deactivate the device. Finally, the pivot bar does not extend very high onto the door. An intruder can exert force on the upper portion of the door which may break or significantly damage the door, and allow an intruder to force their way in.

In light of the above mentioned disadvantages with the prior art door security devices, it is an object of this invention to disclose a door security device which is aesthetically pleasing, does not occupy a large amount of space, is easy for a person to operate (without having to bend over), has a minimum number of working parts, and is sufficiently strong and functional to prevent forced entry without causing extensive damage to the door itself.

SUMMARY OF THE INVENTION

The invention herein disclosed relates to a door security apparatus which is particularly adapted to protect premises or buildings from forced entry and residences from home invasion. The apparatus comprises a hollow elongated housing which can be mounted vertically on an interior surface of a door and has a lower end which is spaced slightly from the floor of the premises. An elongated principal brace bar fits slideably and rotatably into the housing and has a vertical orientation, which is coaxial to the housing. The principal brace bar also has a lower end, which extends out of the bottom of the housing, but requires a small amount of clearance from the floor.

The device further comprises at least one substantially horizontal rod, which has a proximate end rigidly mounted to the lower end of the principal brace bar and a distal end, which extends in a horizontal fashion towards the inside of the premises. The horizontal rod fits through a vertically oriented, slideable brace bar, which has a hole in its body, corresponding to the horizontal rod. The slideable brace bar is mounted on the horizontal rod, in such a manner that the rod slides back and forth through the hole as the door moves back and forth from partially open to closed positions. In its active position, the lower end of the slideable brace bar extends below the surface of the floor.

Finally, the apparatus includes a receptacle in the floor, which receives the lower end of the slideable brace bar and immobilizes the slideable brace bar at the predetermined position of the receptacle. In this manner, when the door is opening, the horizontal rod slides towards the interior of the premises through the hole in the slideable brace bar. Eventually, the door reaches a position where the proximate end of the horizontal rod reaches the slideable brace bar and the slideable brace bar abuts against the principal vertical brace bar. Since the slideable brace bar is immobilized, the door is braced in this partially open position. On the other hand, when the door is closing, the horizontal rod slides backwards through the hole in the slideable brace bar. Eventually, the door will come to a rest in a fully closed position when the slideable brace bar is near the distal end of the horizontal rod.

Advantageously, the apparatus may further comprise a hole on the upper portion of the housing and a handle, protruding through the hole, which is attached to the upper portion of the principal brace bar. The handle may then be lifted to an elevated position, raising the slideable brace bar and disengaging it from the receptacle in the floor. With the slideable brace bar disengaged, the door may swing freely to and from a fully open position without impediment. By lowering the handle back to an active position, a resident may lower the slideable brace bar back into the receptacle, thereby reducing the door's range of travel to positions between the fully closed position and the partially open position.

Preferably, the device may further comprise a locking mechanism which can secure the handle in the elevated position, or in the active position, such that the slideable brace bar may be locked in the in the disengaged position or locked in the floor receptacle. The locking mechanism may be implemented using a threaded member, which is tightenable against the housing or against a back plate mounted to the housing in a vicinity of the aperture.

Advantageously, the apparatus may include a second receptacle in the floor. The second receptacle is also dimensioned to receive the lower end of the slideable brace bar, but it is positioned adjacent to the interior surface of the closed door. If the slideable brace bar is inserted into this receptacle, then it will be immobilized immediately adjacent to the closed door and will brace the door in a fully closed position.

Advantageously, there may be a plurality of horizontal brace bars. There may also be a vertically oriented stopping column affixed to the distal end of the substantially horizontal rod. Such a stopping column may be operative to prevent the slideable brace bar from becoming disengaged from the substantially horizontal rod.

Preferably, there may be magnets on the elongated principal brace bar, the slideable brace bar, or the vertically oriented stopping column, which may be operative to gently affix the slideable brace bar at the proximate and/or distal ends of the substantially horizontal rod.

To improve the appearance of the device, the housing may be made of brass.

Advantageously, the handle of the device may be rotated such that the substantially horizontal rod can be rotated to a position that is substantially co-planar with the door.

To reduce the amount of material required, the housing may be a plurality of brackets mounted to the door.

To allow operation of the device from a remote location, there may be an electric motor attached to either the principal brace bar or the handle, and a remote control device which controls the electric motor to lower and raise the principle brace bar.

Another aspect of this invention concerns a door security apparatus adapted to protect a premises or building from forced entry and home invasion. The apparatus comprises a substantially hollow, elongated housing and an elongated principal brace bar, which is disposed so as to slideably and rotatably insert into the housing. The principal brace bar is coaxial to the housing and has an exterior end, which extends out of the housing at one end thereof. The apparatus also has at least one substantially perpendicular rod. The substantially perpendicular rod has a proximate end rigidly mounted to the exterior end of the principal brace bar outside of the housing, and a distal end, which extends outward, in a substantially perpendicular fashion, from the principal brace bar. Finally, the apparatus comprises a slideable brace bar with at least one hole therein. The hole corresponds to the substantially perpendicular rod, allowing the slideable brace bar to be mounted on the substantially perpendicular rod, in such a manner that the substantially perpendicular rod slides through the hole therein.

The elongated principal brace bar, the substantially perpendicular rod and the slideable brace bar are operative, in combination, to brace the door in a partially open position, so as to prevent forced entry and home invasion through the door.

Advantageously, the door security apparatus may be mountable to a conventional door, such that the apparatus may be operative to brace the door in a partially open position, and the sliding of the substantially perpendicular rod through the hole in the slideable brace bar may be operative to allow movement of the door between a closed position and the partially open position, where the door is braced.

Advantageously, the apparatus may further comprise a receptacle dimensioned to receive an active end of the slideable brace bar, and operative to immobilize the slideable brace bar at a predetermined position. In this manner, when the door is opening, the substantially perpendicular rod may slide towards an interior of the premises through the hole in the slideable brace bar. Eventually, the door will reach a partially open position, where the proximate end of the substantially perpendicular rod reaches the slideable brace bar and the slideable brace bar abuts against the principal vertical brace bar, thereby bracing the door in the partially open position. When the door is closing, the substantially perpendicular rod may slide away from the interior of the premises through the hole in the slideable brace bar. Eventually the door will come to a rest in a fully closed position when the slideable brace bar approaches the distal end of the substantially perpendicular rod.

BRIEF DESCRIPTION OF THE DRAWINGS

FIG. 1 depicts the preferred embodiment of the invention in each of its three active positions.

FIG. 2 is a magnified diagram of the active part of the apparatus, showing the horizontal rods, the slideable brace bar and a portion of the principal brace bar.

FIG. 3 depicts a how the invention can be disengaged and rotated into planar contact with the door when no security is desired.

FIG. 4 displays a detailed view of the invention's locking mechanism, as positioned when the device is in any of its active orientations.

FIG. 5 displays a detailed view of the invention's locking mechanism, as positioned when the device is in its inactive orientation.

DESCRIPTION OF THE PREFERRED EMBODIMENT

Referring to FIG. 1, the preferred embodiment of the present invention is shown in each of the three active positions. In FIG. 1-*a*, the door 20 is in the closed position. The principal vertical brace bar 12 extends from its bottom end into the housing 11 and at least as high as the locking shaft 24. The horizontal rods 13 are affixed near the bottom of the principal brace bar 12 and extend outward from the door 20. When the door 20 is in the closed position, the slideable brace bar 14 is located at the distal end of the horizontal rods 13 abutting against the vertical stop 15. Optionally, a magnet or other clasping device (not shown) can be positioned between the slideable brace bar 14 and the device stop 15 so as to gently secure the door 20 in the closed position, such that it will not open and close due to mild external forces such as wind etc. The housing 11 may be continuous, or may be comprised of a plurality of brackets (not shown individually) mounted to the door 20.

In FIG. 1-*b* the door 20 is shown in the open position. The horizontal rods 13 are forced to slide through the slideable brace bar 14, until the slideable brace bar 14 abuts against the principal vertical brace bar 12. At this point, the door 20 is prevented from opening any further by the action of the slideable brace bar 14, which fits at one end into the interior floor plug 21 and acts against the principal vertical brace bar 12 on the other end. As the principal vertical brace bar 12 extends a relatively large distance up the housing 11, it provides substantial bracing against forced entry. Additionally, a magnet or other clasping mechanism (not shown) may be affixed between the slideable brace bar 14 and the vertical brace bar 12, so as to gently secure the door 20 in the open position, such that it will not open and close due to mild external forces such as wind etc.

FIG. 1-*c* shows the device configured so as to lock the door 20 in a completely closed position. The slideable brace bar 14 is inserted into the floor plug 23, which is located adjacent to the door 20. As with the door open position of FIG. 1-*b*, the slideable brace bar 14 abuts against the principal vertical brace bar 12. The door 20 is prevented from opening because the slideable brace bar 14 is secured at one end by the floor plug 23 and abuts the principal vertical brace bar 12 on the other end.

FIG. 2 is a magnified depiction of the active part of the device FIGS. 2-*a* and 2-*b* show how the horizontal rads 13 translate through holes 22 bored in the slideable brace bar 14 from the closed door position (FIG. 2-*a*) to the open door position (FIG. 2-*b*).

FIG. 3 shows how the device can be disengaged from the floor when no security is desired (i.e. when it is required to fully open the door). In the active orientation of FIG. 3-*b*, the principal vertical brace bar 12 is displaced upward through the housing 11. Lifting the principal vertical brace bar 12 also disengages the slideable brace bar 14 from the floor plug 21. The entire apparatus is then rotated so as to be substantially co-planar with the door 20. The device is now in the disengaged orientation depicted by FIG. 3-*a*. Alternatively, the principal vertical brace bar 12 may be raised and lowered by an electric motor (not shown) which is attached either to the locking shaft 24 or the principal vertical brace bar 12, and is controlled by a remote control device (not shown) such that the device can secure the door 20 in a fully closed position and be disengaged from outside the premises.

A locking mechanism may also be introduced which locks the device in the engaged (FIG. 3-*b*) or disengaged (FIG. 3-*a*) orientations. The locking mechanism is more closely depicted in FIGS. 4 and 5. FIG. 4 depicts the locking mechanism 30 in one of the active orientations. The shaft 24 of the locking knob 25 is threaded into the principal vertical brace bar (not shown) and is lowered to the bottom of lock-slot 28. When the principal vertical brace bar is lowered in this manner, its bottom end (not shown) is inserted into one of the floor plugs (not shown) so as to brace the device in one of its active orientations. When the locking mechanism 30 is in this lowered positions, the locking knob 25 can be rotated causing the threaded locking shaft 24 to tighten against the back plate 26. In this manner, the device is locked in the active position until the locking knob 25 is loosened again.

FIG. 5 depicts the locking mechanism 30 positioned in such a manner that the device is in its inactive position. In this configuration, the locking knob 25 is lifted (causing the principal vertical brace bar (not shown) to be raised out of the floor plug (not shown). Once raised in this manner, the locking knob 25 can be raised to the top of lock-slot 28 and rotated into recess 27. Once the locking knob 25 is positioned in recess 27, it will not allow the principal brace bar to slide back down. For additional certainty, the locking knob 25 may be tightened such that its shaft 24 is tightened against the sidewall of the housing 11.

Referring simultaneously to FIGS. 1(*a,b,c*) and 3(*a,b*), the apparatus disclosed above has the following advantages over the prior art inventions mentioned previously. The device is relatively small and does not extend a large distance outward from the door 20 (i.e. preferably, the horizontal rods 13 are approximately 6–10 cm in length). Additionally, the device can be made out of attractive materials such as brass or plated with various metals or synthetic coverings, which make it aesthetically attractive in comparison to the prior art. The device may be easily engaged and disengaged by lifting from the locking knob 25 near the top of the principal vertical brace bar 12, which does not require the resident or operator to bend over a great deal. The operation of the device is simple; there are relatively few parts, which are not susceptible to breakage or malfunction, and installation of the device is elementary. When an intruder attempts to force the door 20 open, the vertical brace bar 12 extends a considerable distance up the door 20. Consequently, the pressure is distributed over the entire length of the principal vertical brace bar 12 and the housing 11. This distribution of force effectively braces the door 20 against forced entry and protects the door 20 from incidental damage.

It should be understood that the above description is intended for illustrative purposes only, and is not intended to limit the scope of the present invention in any way. Those skilled in the art will appreciate that various modifications can be made to the embodiments discussed above without departing from the spirit of the present invention.

What is claimed is:

1. A door security apparatus for protecting a building from forced entry, which comprises:

(a) a substantially hollow, elongated housing mounted in a vertical orientation on an interior surface of a door, a lower end of said housing spaced slightly from a floor of said premises;

(b) an elongated principal brace bar, which is disposed so as to slideably and rotatably insert into said housing, said principal brace bar having a vertical orientation, which is coaxial to said housing and having a lower end, which extends below the lower end of said housing, but retains a clearance above the floor of said premises;

(c) at least one substantially horizontal rod, said rod having a proximate end, which is rigidly mounted to the lower end of said principal brace bar below the lower end of said housing, and a distal end, which extends in a substantially horizontal fashion towards an interior of said premises;

(d) a vertically oriented, slideable brace bar having at least one hole therein, said hole corresponding to said substantially horizontal rod, said slideable brace bar mounted on said substantially horizontal rod, in such a manner that said substantially horizontal rod is operative to slide through said hole as said door moves to and from a closed position; and (e) a receptacle in the floor, which is dimensioned to receive a lower end of said slideable brace bar and is operative to:

(i) receive the lower end of said slideable brace bar, which extends below the floor of said premises, and (ii) immobilize said slideable brace bar at a predetermined position of said receptacle, such that:

when said door is opening, said substantially horizontal rod slides towards the interior of said premises through the hole in said slideable brace bar, said door reaching a partially open position, where the proximate end of said substantially horizontal rod reaches said slideable brace bar and said slideable brace bar abuts against said principal vertical brace bar, thereby bracing said door in said partially open position, and when said door is closing, said substantially horizontal rod slides away from the interior of said premises through the hole in said slideable brace bar, said door coming to a rest in a fully closed position when said slideable brace bar is at the distal end of said substantially horizontal rod.

2. An apparatus according to claim 1, which further comprises:

(a) an aperture on an upper portion of said elongated housing; and (b) a handle attached to an upper portion of said elongated principal brace bar, said handle protruding from said aperture in said housing such that:

said handle is retractable to an elevated position, so as to disengage said slideable brace bar from said receptacle in the floor, thereby allowing said door to swing freely to and from a fully open position without impediment, and said handle is lowerable to an active position, so as to extend said slideable brace bar downward into said receptacle in the floor, thereby reducing the range of travel of said door to positions between said fully closed position and said partially open position.

3. An apparatus according to claim 2, which further comprises a locking mechanism operative to secure said handle in said elevated position, thereby securing said slideable brace bar in a disengaged position.

4. An apparatus according to claim 2, which further comprises a locking mechanism operative to secure said handle in said active position, thereby securing said slideable brace bar in said receptacle in the floor.

5. An apparatus according to claim 2, which further comprises a second receptacle in the floor, said second receptacle being dimensioned to receive the lower end of said slideable brace bar and positioned adjacent to the interior surface of said door when said door is in a fully closed position, such that if said slideable brace bar is inserted into said second receptacle, said slideable brace bar will be located at the proximate end of said substantially horizontal rod, abutting against said principal vertical brace bar, thereby bracing said door in a fully closed position.

6. An apparatus according to claim 1, wherein there is a plurality of substantially horizontal brace bars.

7. An apparatus according to claim 3, wherein said locking mechanism comprises a threaded member, which is tightenable against one of: said housing and a back plate mounted to said housing in a vicinity of said aperture.

8. An apparatus according to claim 4, wherein said locking mechanism comprises a threaded member, which is tightenable against one of: said housing and a back plate mounted to said housing in a vicinity of said aperture.

9. An apparatus according to claim 1, which further comprises a vertically oriented stopping column, which is affixed to the distal end of said substantially horizontal rod and is operative to prevent said slideable brace bar from becoming disengaged from said substantially horizontal rod.

10. An apparatus according to claim 9, wherein said apparatus further comprises magnets on at least one of: said elongated principal brace bar, said slideable brace bar and said vertically oriented stopping column, so as to gently affix said slideable brace bar at either of the proximate and the distal ends of said substantially horizontal rod.

11. An apparatus according to claim 1, wherein said housing is made of brass.

12. An apparatus according to claim 2, wherein said handle can be rotated when it is in said elevated position, said rotation of said handle causing a corresponding rotation of said elongated principal brace bar and causing a corresponding rotation of said substantially horizontal rod, such that said substantially horizontal rod become substantially co-planar to said door.

13. An apparatus according to claim 1, wherein said housing is discontinuous and comprises a plurality of brackets mounted to said door.

14. An apparatus according to claim 2 which further comprises an electric motor which is attached to either of said principal brace bar or said handle, and a remote control device which is operable to control said electric motor which is adapted to lower and raise said principle brace bar from a remote location.

15. A door security apparatus for protecting a building from forced entry, which comprises:

(a) a substantially hollow, elongated housing mounted in a vertical orientation on an interior surface of a door, a lower end of said housing spaced slightly from a floor of said premises;

(b) an elongated principal brace bar, which is disposed so as to slideably and rotatably insert into said housing, said principal brace bar having a vertical orientation, which is coaxial to said housing and having a lower end, which extends below the lower end of said housing, but retains a clearance above the floor of said premises;

(c) at least one substantially horizontal rod, each rod having a proximate end, which is rigidly mounted to the lower end of said principal brace bar below the lower end of said housing, and a distal end, which extends in a substantially horizontal fashion towards an interior of said premises;

(d) a vertically oriented, slideable brace bar having at least one hole therein, said hole corresponding to said substantially horizontal rod, said slideable brace bar mounted on said substantially horizontal rod, in such a manner that said substantially horizontal rod is operative to slide through said hole as said door moves to and from a closed position;

(e) a receptacle in the floor, which is dimensioned to receive a lower end of said slideable brace bar and is operative to:

(i) receive the lower end of said slideable brace bar, which extends below the floor of said premises, and (ii) immobilize said slideable brace bar at a predetermined position of said receptacle, such that:

when said door is opening, said substantially horizontal rod slides towards the interior of said premises through the hole in said slideable brace bar, said door reaching a partially open position, where the proximate end of said substantially horizontal rod reaches said slideable brace bar and said slideable brace bar abuts against said principal vertical brace bar, thereby bracing said door in said partially open position, and when said door is closing, said substantially horizontal rod slides away from the interior of said premises through the hole in said slideable brace bar, said door coming to a rest in a fully closed position when said slideable brace bar is at the distal end of said substantially horizontal rod;

(f) an aperture on an upper portion of said elongated housing; and (g) a handle attached to an upper portion of said elongated principal brace bar, said handle protruding from said aperture in said housing, such that:

said handle is retractable to an elevated position, so as to disengage said slideable brace bar from said receptacle in the floor, thereby allowing said door to swing freely to and from a fully open position without impediment, and said handle is lowerable to an active position, so as to extend said slideable brace bar downward into said receptacle in the floor, thereby reducing the range of travel of said door to positions between said fully closed position and said partially open position.

16. An apparatus according to claim 15, which further comprises a locking mechanism operative to secure said handle in said elevated position, thereby securing said slideable brace bar in a disengaged position, and to secure said handle in said active position, thereby securing said slideable brace bar in said receptacle in the floor.

17. An apparatus according to claim 15, wherein said housing is discontinuous and comprises a plurality of brackets mounted to said door.

18. An apparatus according to claim 15 which further comprises an electric motor which is attached to either of said principal brace bar or said handle; and a remote control device which is operable to control said electric motor which is adapted to lower and raise said principle brace bar from a remote location.

19. A door security apparatus for protecting a building from forced entry, which comprises:

(a) a substantially hollow, elongated housing;

(b) an elongated principal brace bar, which is disposed so as to slideably and rotatably insert into said housing, said principal brace bar being coaxial to said housing and having an exterior end, which extends out of said housing at one end thereof;

(c) at least one substantially perpendicular rod having a proximate end, which is rigidly mounted to the exterior end of said principal brace bar outside of said housing, and having a distal end, which extends outward, in a substantially perpendicular fashion, from said principal brace bar; and (d) a slideable brace bar having at least one hole therein, said hole corresponding to said substantially perpendicular rod, said slideable brace bar mounted on said substantially perpendicular rod, in such a manner that said substantially perpendicular rod is operative to slide through said hole, said elongated principal brace bar, said substantially perpendicular rod and said slideable brace bar being operative, in combination, to brace a door in a partially open position, so as to prevent forced entry and home invasion through said door.

20. An apparatus according to claim 19, wherein said door security apparatus is mountable to a conventional door, such that said apparatus is operative to brace said door in a partially open position, and said sliding of said substantially perpendicular rod through the hole in said slideable brace bar being operative to allow movement of said door between a closed position and said partially open position, where said door is braced.

21. An apparatus according to claim 20 which further comprises a receptacle, which is dimensioned to receive an active end of said slideable brace bar and is operative to immobilize said slideable brace bar at a predetermined position of said receptacle, such that:

when said door is opening, said substantially perpendicular rod slides towards an interior of said premises through the hole in said slideable brace bar, said door reaching a partially open position, where the proximate end of said substantially perpendicular rod reaches said slideable brace bar and said slideable brace bar abuts against said principal vertical brace bar, thereby bracing said door in said partially open position, and when said door is closing, said substantially perpendicular rod slides away from the interior of said premises through the hole in said slideable brace bar, said door coming to a rest in a fully closed position when said slideable brace bar reaches the distal end of said substantially perpendicular rod.

22. An apparatus according to claim 21, which further comprises:

(a) an aperture on an upper portion of said elongated housing; and (b) a handle attached to an upper portion of said elongated principal brace bar, said handle protruding from said aperture in said housing, such that:

said handle is retractable to an retracted position, so as to disengage said slideable brace bar from said receptacle, thereby allowing said door to swing freely to and from a fully open position without impediment, and said handle is moveable to an active position, so as to extend said slideable brace bar into said receptacle, thereby reducing the range of travel of said door to positions between said fully closed position and said partially open position.

23. An apparatus according to claim 22, which further comprises a locking mechanism operative to secure said handle in said retracted position, thereby securing said slideable brace bar in a disengaged position, and to secure said handle in said active position, thereby securing said slideable brace bar in said receptacle.

24. An apparatus according to claim 19, wherein said housing is discontinuous and comprises a plurality of brackets.

25. An apparatus according to claim 22 which further comprises an electric motor which is attached to either of said principal brace bar or said handle; and a remote control device which is operable to control said electric motor which is adapted to lower and raise said principle brace bar from a remote location.

* * * * *